US006805772B2

(12) United States Patent
Schwarz

(10) Patent No.: US 6,805,772 B2
(45) Date of Patent: Oct. 19, 2004

(54) METHOD AND APPARATUS FOR MANUFACTURING A FIBROUS MATERIAL WEB

(75) Inventor: Michael Schwarz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/118,951

(22) Filed: Apr. 10, 2002

(65) Prior Publication Data

US 2002/0179268 A1 Dec. 5, 2002

(30) Foreign Application Priority Data

Apr. 12, 2001 (DE) ..... 101 18 508

(51) Int. Cl.[7] ..... D21H 23/12

(52) U.S. Cl. ..... 162/198; 162/263; 162/252; 162/259; 162/DIG. 11; 700/128

(58) Field of Search ..... 162/158, 164.1, 162/168.1, 175, 181.1, 198, 199, 252, 253, 254, 256, 258, 259, 263, 264, 262, DIG. 18, DIG. 11; 700/127–129; 250/559.01, 559.05; 382/108

(56) References Cited

U.S. PATENT DOCUMENTS

| | | | | | |
|---|---|---|---|---|---|
| 4,644,174 | A | * | 2/1987 | Ouellette et al. | 250/559.01 |
| 4,648,712 | A | * | 3/1987 | Brenholdt | 356/73 |
| 4,952,280 | A | * | 8/1990 | Hemel et al. | 162/198 |
| 5,314,581 | A | * | 5/1994 | Lin et al. | 162/263 |
| 5,393,378 | A | | 2/1995 | Yakabe et al. | |
| 5,622,602 | A | * | 4/1997 | Yakabe et al. | 162/252 |
| 6,086,716 | A | * | 7/2000 | Watson et al. | 162/198 |
| 6,162,331 | A | | 12/2000 | Ruf et al. | |
| 6,179,964 | B1 | | 1/2001 | Begemann et al. | |
| 6,203,665 | B1 | | 3/2001 | Begemann | |
| 6,290,816 | B1 | * | 9/2001 | Graf | 162/253 |
| 6,301,373 | B1 | * | 10/2001 | Bernie et al. | 382/108 |
| 6,521,089 | B1 | | 2/2003 | Griech et al. | |
| 6,562,196 | B1 | * | 5/2003 | Huovila et al. | 162/198 |
| 2003/0089479 | A1 | | 5/2003 | Griech et al | |

FOREIGN PATENT DOCUMENTS

| | | | | |
|---|---|---|---|---|
| DE | 19634997 | | 8/1998 | |
| DE | 19736048 | | 2/1999 | |
| DE | 19835295 | | 2/2000 | |
| DE | 10043142 | | 3/2001 | |
| EP | 1054102 | | 11/2000 | |
| JP | 01260091 | A * | 10/1989 | D21F/9/00 |

OTHER PUBLICATIONS

Weseman, B. D., "Kinetics of Fiber Floc Formation", Institute of Paper Science and Technology (1999).*

H–J Schultz et al., "Lasertechnologie zur Nutzung des Potentials eines Blattbildungssystems in Verbindung mit der BTF–Universalverteiler–Stoffauflauf–Technologie", in Wochenblatt fur Papierfabrikation, Dec. 11, 2000, pp. 772–781.

(List continued on next page.)

*Primary Examiner*—Steven P. Griffin
*Assistant Examiner*—Eric Hug
(74) *Attorney, Agent, or Firm*—Greenblum & Bernstein, P.L.C.

(57) ABSTRACT

Process and apparatus for manufacturing a fibrous material web. The apparatus includes an automatic formation regulator, and the process includes on-line measuring of formation of the fibrous material web, utilizing the on-line measured formation as a controlled variable, and maintaining the formation at a preselectable target level via the automatic formation regulator.

41 Claims, 5 Drawing Sheets

OTHER PUBLICATIONS

Patent Abstracts of Japan No. 01246491, published Oct. 2, 1989.

Patent Abstracts of Japan No. 01260091, published Oct. 17, 1989.

Patent Abstracts of Japan No. 03130492, published Jun. 4, 1991.

Patent Abstracts of Japan No. 04082987, published Mar. 16, 1992.

Patent Abstracts of Japan No. 05033283, published Feb. 9, 1993.

Patent Abstracts of Japan No. 06184980, published Jul. 5, 1994.

Article by D.J. Jones et al., "A New Non–Linear Optimal Control Strategy for Paper Formation", *Measurement and Control*, vol. 32, Oct. 1999.

* cited by examiner

Prior art: regulation of the retention

METHOD AND APPARATUS FOR MANUFACTURING A FIBROUS MATERIAL WEB

CROSS-REFERENCE TO RELATED APPLICATIONS

The present application claims priority under 35 U.S.C. §119 of German Patent Application No. 101 18 508.1, filed on Apr. 12, 2001, the disclosure of which is expressly incorporated by reference herein in its entirety.

BACKGROUND OF THE INVENTION

1. Field of the Invention

The present invention relates to a method and an apparatus for manufacturing a fibrous material web, in particular paper or cardboard web.

2. Discussion of Background Information

In the previously known apparatuses for paper manufacture, retention is determined on-line through the stock consistencies measured in the back water and in the stock feed to the headbox, and is kept constant through regulation of the retention agent quantity or quantities. A known paper apparatus with retention regulation of this nature is shown schematically in FIG. 1.

This method based on a regulation of retention has, among other things, the disadvantage that formation becomes increasingly worse as retention becomes greater. To avoid poor formation, the retention must be set for the maximum possible retention with a large safety margin.

In this connection, formation is generally understood to mean the structure and degree of uniformity of fiber distribution in the fibrous material web, e.g. paper, either measured or evaluated, e.g. by light sent through. Formation is generally also referred to as the "look-through" of the fibrous material web or of the paper. Retention is understood to mean the proportion of the mass retained by the wire or wires relative to the total mass applied to the wire.

SUMMARY OF THE INVENTION

The present invention provides an improved method and an improved apparatus of the aforementioned type, in which the aforementioned disadvantages are eliminated.

In this regard, the invention provides a method for manufacturing a fibrous material web, in particular paper or cardboard web, in which the formation of the fibrous material web is measured on-line as a controlled variable and is maintained at a preselectable target level via an automatic formation regulator.

In this connection, the formation can be maintained at the preselectable target level in particular by appropriately changing the added quantity of at least one retention agent.

According to one preferred practical embodiment of the method in accordance with the invention, the retention is continually maintained at the respective maximum possible value.

In that two different retention agents are advantageously added at two different points (dual system), the retention can also be constantly maintained at a preselectable high level. Advantageously, the formation is maintained at the preselectable target level through appropriately changing the ratio of the added quantities of the two retention agents.

In this connection, formation regulation can be performed in various ways. A few possibilities are mentioned below purely by way of example.

Thus, for instance, formation can be set or regulated in that two retention agent mass flows $Q_{R1}$, $Q_{R2}$ at a constant ratio $Q_{R1}/Q_{R2}$ are changed appropriately, or increased or reduced.

Another possibility includes, for example, that the formation is measured, the measured value is compared to a target value, the added quantity of a first retention agent of a dual system is adjusted appropriately to match the formation to the target value, and in order to set the highest possible level of retention the added quantity of a second retention agent of the dual system, or the ratio between the added quantities of the two retention agents, is corrected up to the point where the formation begins to worsen again.

Moreover, it is possible, for example, to superimpose the formation regulation on a retention regulation. In this connection the retention regulation, which can be accomplished in a conventional manner, can in particular be faster than the formation regulation.

The two different retention agents can, for example, include polymers with different charge densities (anionic/cationic) and/or different molecular weights. In this connection, the two different retention agents can include, e.g., polyethylene imine (PEI) and polyacrylamide (PAM).

In accordance with another practical embodiment of the method in accordance with the invention, the first retention agent includes a polymer, e.g. polyacrylamide, and the second retention agent includes inorganic microparticles, e.g. bentonite, hydrocol, etc. Thus, for example, one polymer can be provided for coarse flocculation and one agent for fine flocculation.

In certain cases, it is advantageous if raw material influences and/or the water flow in the wet section are also included in formation regulation. This is possible through the use of fuzzy logic and/or predictive controls, in particular.

Thus, for example, when short-fibered raw materials are used, the formation is worsened to a lesser extent with increasing retention than when long-fibered materials are employed.

This material-dependent relationship between formation and retention can be taken into account in the control algorithm. This can be accomplished, for example, within the framework of a formation regulation superimposed over a retention regulation, or in that the ratio $Q_{R1}/Q_{R2}$ of the mass flows of the retention agents of the dual system are also selected by fiber type (raw material type).

The apparatus in accordance with the invention for manufacturing a fibrous material web, in particular paper or cardboard web, accordingly includes an automatic formation regulator in which the formation of the fibrous material web is measured on-line as a controlled variable and is maintained at a preselectable target level.

The present invention is directed to a process for manufacturing a fibrous material web in an apparatus having an automatic formation regulator. The process includes on-line measuring of formation of the fibrous material web, utilizing the on-line measured formation as a controlled variable, and maintaining the formation at a preselectable target level via the automatic formation regulator.

According to a feature of the instant invention, the fibrous material web can include one of a paper or cardboard web.

In accordance with another feature of the invention, the formation can be maintained at the preselectable target level by changing an added quantity of at least one retention agent.

The process can further include continually maintaining retention at a maximum possible value.

Further, different retention agents may be added at different points, and the process can further include adjusting the retention. The two different retention agents may include polyethylene imine (PEI) and polyacrylamide (PAM).

Moreover, two different retention agents can be added at two different points, and the process may further include constantly maintaining the retention at a preselectable high level.

According to still another feature of the invention, two different retention agents may be added at two different points, and the process can further include maintaining the formation at the preselectable target level by changing a ratio of added quantities of the two different retention agents.

In accordance with another feature of the present invention, two different retention agents can be added at two different points, and the two different retention agents may include polymers with at least one of different charge densities and different molecular weights. The different charge densities may include anionic/cationic differences.

The process can further include one of adjusting or regulating the formation by one of increasing and decreasing a constant ratio $Q_{R1}/Q_{R2}$, wherein $Q_{R1}$ and $Q_{R2}$ represent retention agent mass flows.

After the on-line measurement of the formation, the process may further include comparing the measured value to a target value, adjusting an added quantity of a first retention agent of a dual system to match the formation to the target value, and correcting one of an added quantity of a second retention agent and a ratio between the added quantities of the two retention agents to a point at which the formation begins to worsen. Further, the correcting enables the setting of a highest possible level of retention.

In accordance with a further feature of the present invention, the formation regulation may be superimposed on a retention regulation.

Two different retention agents can be added at two different points, such that a first retention agent may include a polymer and a second retention agent may include inorganic microparticles. Further, the polymer can include polyacrylamide and the inorganic microparticles can include at least one of bentonite and hydrocol.

According to the invention, at least one of raw material influences and water flow in a wet section can be included in formation regulation.

Further, in accordance with the invention, formation regulation may utilize at least one of fuzzy logic and predictive controls.

In accordance with still another feature of the instant invention, at least one of at least one on-line measured formation value and at least one stock consistency value can be input into a controller for regulating the formation, and the process may further include adjusting a level of the formation by using a manipulated variable output by the controller to adjust one of a mass flow rate or volume flow rate of at least one retention agent. Moreover, the at least one stock consistency value can include at least one of the stock consistency value of the low consistency back water and the stock consistency value of the high consistency fiber suspension to the headbox. The low consistency back water may include white water. Further, at least one value for at least one stock parameter may be input to the controller as an additional input variable.

The present invention is directed to an apparatus for manufacturing a fibrous material web that includes an on-line measuring device structured and arranged to measure formation of the fibrous material web, and an automatic formation regulator structured and arranged to receive the formation of the fibrous material web from the on-line measuring device as a controlled variable, and to maintained the formation at a preselectable target level.

According to a feature of the invention, the apparatus can further include a device for changing an added quantity of at least one retention agent. The changing of the added quantity of the at least one retention agent can maintain the formation at the preselectable target level.

That apparatus can further include a device to continually maintain retention at a respective maximum possible value.

Moreover, the apparatus may include devices for adding two different retention agents at two different points, and a device structured and arranged to constantly maintain the retention at a preselectable high level.

In accordance with a further feature of the invention, the apparatus may further include devices for adding two different retention agents at two different points, and a device structured and arranged to maintain the formation at the preselectable target level by changing quantities of the two added retention agents.

The apparatus can also include devices for adding two different retention agents at two different points. The two different retention agents may include polymers with at least one of different charge densities and different molecular weights. Further, the different charge densities can include anionic/cationic differences.

In accordance with another feature of the present invention, the apparatus may further include a device for one of adjusting or regulating the formation by one of increasing and decreasing a constant ratio $Q_{R1}/Q_{R2}$, wherein $Q_{R1}$ and $Q_{R2}$ represent retention agent mass flows.

Further, the apparatus may include a device for comparing a measured formation value to a target value, a device for adjusting an added quantity of a first retention agent of a dual system to match the formation to the target value, and a device for correcting one of an added quantity of a second retention agent and a ratio between the added quantities of the two retention agents to a point at which the formation begins to worsen. The device for correcting may enable the setting of a highest possible level of retention.

According to the invention, the automatic formation regulator may be superimposed on a retention regulator.

In accordance with still another feature of the instant invention, the apparatus may include a device for adding different retention agents at different points, and a device for adjusting retention. The two different retention agents may include polyethylene imine (PEI) and polyacrylamide (PAM).

According to a still further feature, the apparatus can include a device for adding two different retention agents at two different points. A first retention agent may include a polymer and a second retention agent may include inorganic microparticles. The polymer can include polyacrylamide and the inorganic microparticles can include at least one of bentonite and hydrocol.

Moreover, the automatic formation regulator may be coupled receive data related to at least one of raw material influences and water flow in a wet section.

Still further, the automatic formation regulator can utilize at least one of fuzzy logic and predictive controls.

In accordance with yet another feature of the present invention, the automatic formation regulator can be structured and arranged to receive as input at least one of at least one on-line measured formation value and at least one stock consistency value, and the automatic formation regulator may be structured and arranged to adjust a level of the formation by using a manipulated variable output in order to adjust one of a mass flow rate or volume flow rate of at least one retention agent. The at least one stock consistency value can include at least one of the stock consistency value of the low consistency back water and the stock consistency value of the high consistency fiber suspension to the headbox. The low consistency back water may include white water. Further, at least one value for at least one stock parameter may be input to the automatic formation regulator as an additional input variable.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
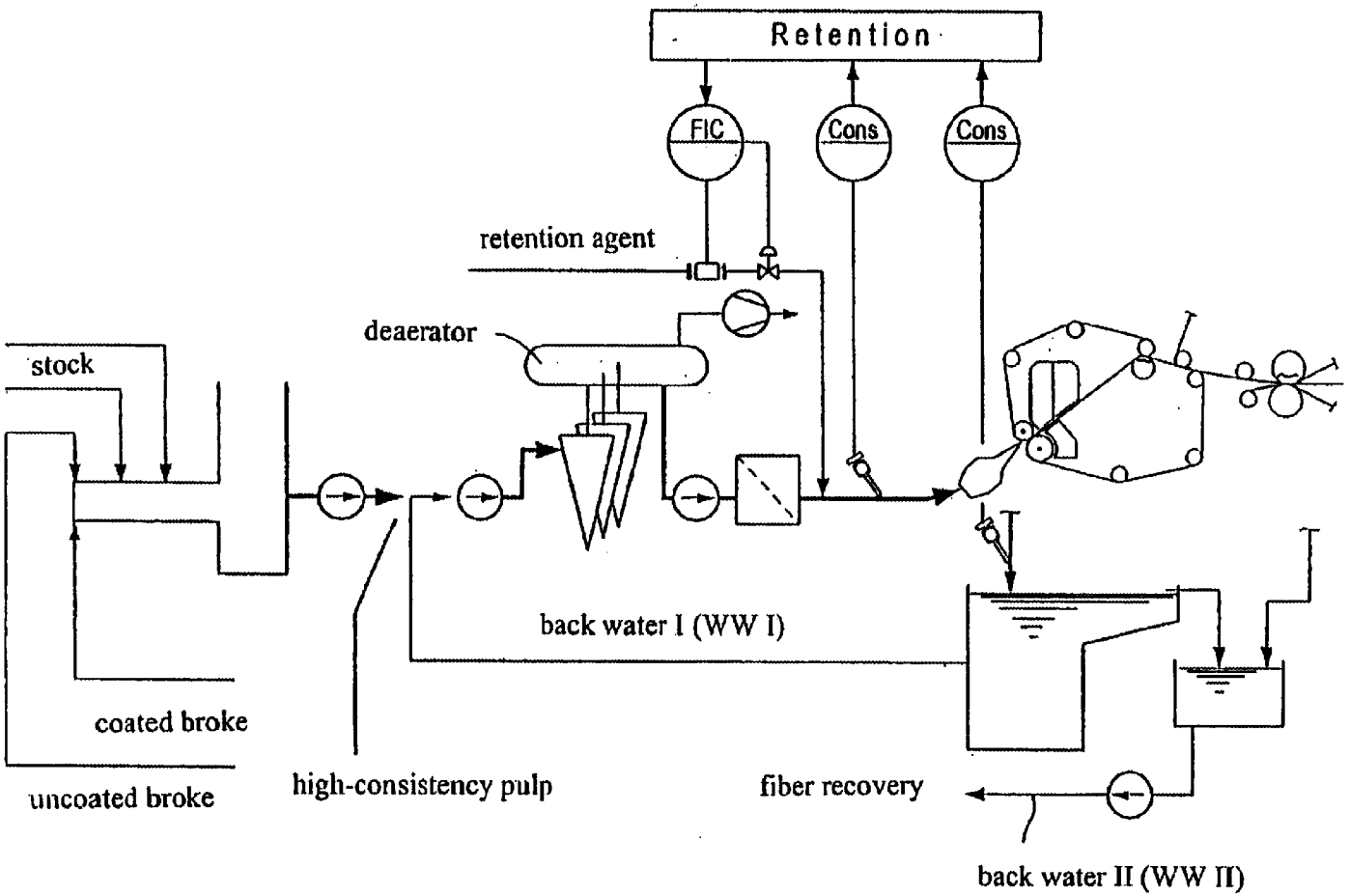
FIG. 1 schematically illustrates a known apparatus for manufacturing a fibrous material web with conventional retention regulation.
Figure 2:
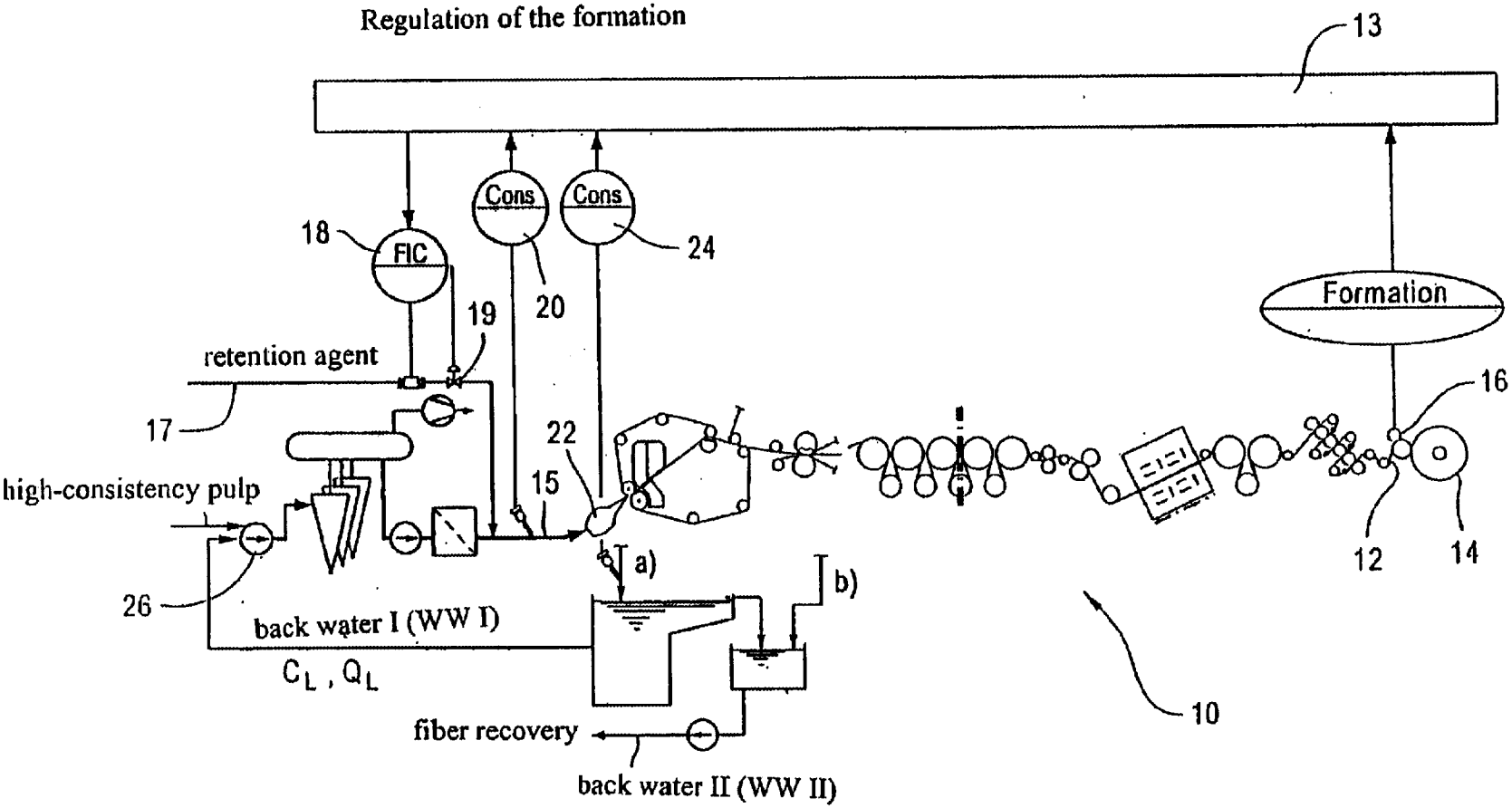
FIG. 2 schematically illustrates an embodiment of the apparatus according to the invention for manufacturing a fibrous material web with regulation of the formation.

FIG. 2 schematically illustrates an exemplary embodiment of an apparatus 10 in accordance with the present invention for manufacturing a fibrous material web 12, which can be, e.g., a paper or cardboard web. In the present case, apparatus 10 comprises an approach flow system, a paper machine and a formation controller 13 for regulating the formation. In this connection, formation controller 13 serves the purpose of quality regulation, in which the formation leads the retention.

The formation of fibrous material web 12 is measured on-line as a controlled variable by a measurement device 16, e.g., a HyperScan Formation Measurement device or an ABB Quality Control System, both by ABB, provided in front of wind-up 14. The relevant measured value is supplied to formation controller 13. Finally, the formation is maintained at a preselectable target level by automatic formation controller 13.

Formation is generally understood to mean the structure and degree of uniformity of the fiber distribution in fibrous material web 12, either measured or evaluated, e.g. by light sent through. Formation is generally also referred to as the "look-through" of the fibrous material web.

Formation can be maintained at the preselectable target level in particular by appropriately changing the added quantity of at least one retention agent.

In the present case, the retention agent flow rate in a line 17 is appropriately changed, e.g. by a flow controller 18, which receives a suitable target value from formation controller 13 for this purpose. Through flow controller 18 (FIC, flow indicated control), the retention agent flow rate in line 17 is measured and compared to the relevant target value supplied by formation controller 13. In addition, an actuator 19, e.g., a valve, provided in line 17 can be acted upon by flow controller 18, through which actuator the retention agent flow rate is appropriately corrected, i.e. matched to the target value.

In addition to the formation value measured on-line by the measurement device 16, at least one stock consistency value, in particular, can also be input to formation controller 13, preferably the stock consistency value of the low consistency back water I (WW I=white water I, $C_L$) and/or the stock consistency value of the high consistency fiber suspension ($C_H$) in feed inlet 15 to headbox 22.

Two such input variables for the formation controller 13, each constituting a stock consistency value, are indicated in FIG. 2 by way of example, and labeled "20" and "24," respectively.

A manipulated variable, output by formation controller 13, can then be used to adjust the mass flow rate or volume flow rate of at least one retention agent such that the formation value adopts the desired level. In the present case, this can be accomplished by at least one flow controller 18, for example, as explained above.

The low consistency $C_L$ of the volume flow rate $Q_L$ does indeed preferably relate to the back water I. The relevant measurement point is labeled a). However, the back water consistency can also be measured at other points for the purpose of regulation. Another possible measurement point is labeled b) in FIG. 2.

As can be seen in FIG. 2, high-consistency pulp is also supplied to the mixing pump 26 in addition to the back water I.

The back water II is supplied to the fiber recovery system.

The retention agent influences not only the retention of the solid particles, but also the formation. Since the formation of finished fibrous material web 12 is measured on-line, the retention can be continually maintained at the respective maximum possible value.

In dual systems, i.e. when two different retention agents are added at two different points, the retention can always be constantly maintained at a high level as well. In this context, the formation can be maintained at the preselectable target level, e.g. by appropriately changing the ratio of the added quantities of the two retention agents.

The formation can, for example, be set or regulated in that two retention agent mass flows $Q_{R1}$, $Q_{R2}$ at a constant ratio $Q_{R1}/Q_{R2}$ are changed appropriately, or increased or reduced.

Another possibility includes, e.g., that the formation is measured, the measured value is compared to a target value, the added quantity of a first retention agent of a dual system is adjusted appropriately to match the formation to the target value, and in order to set the highest possible level of retention, the added quantity of a second retention agent of the dual system, or the ratio between the added quantities of the two retention agents, is corrected up to the point where the formation begins to worsen again.

Figure 3:
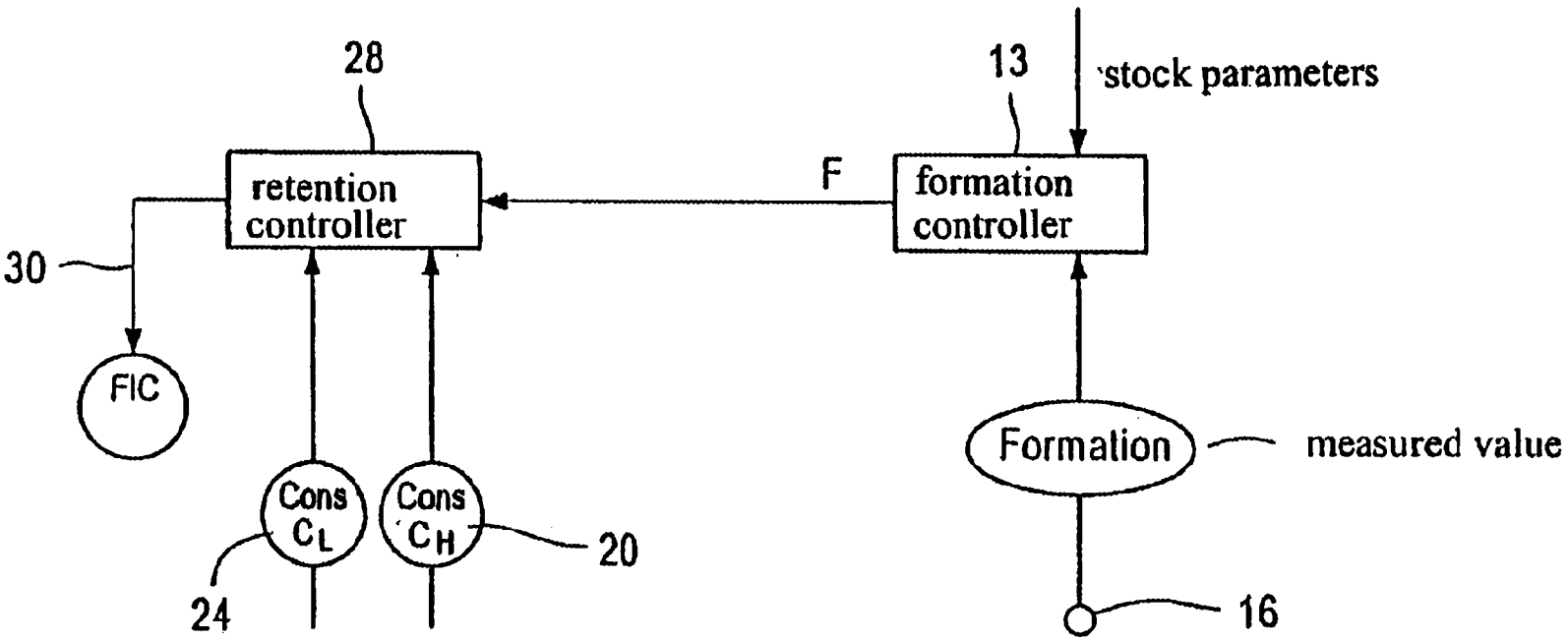
FIG. 3 schematically illustrates the regulation system of another embodiment of the apparatus according to the invention for manufacturing a fibrous material web with a formation regulation superimposed over a retention regulation.

Moreover, it is possible, for example, to superimpose the formation regulation on a retention regulation. FIG. 3 shows a schematic representation of an example regulation system of such an embodiment of the apparatus according to the invention.

As can be seen in FIG. 3, the formation regulation comprising formation controller 13 can be combined with conventional retention regulation comprising a retention controller 28. A control loop comprising controller 13 for formation regulation is superimposed on the control loop comprising controller 28 for retention regulation. In this connection, the retention regulation can be faster than the formation regulation. Formation controller 13 provides to retention controller 28 a signal F, by which it is possible to directly influence, e.g., stock consistency value 24 of low consistency $C_L$ and/or output value 30 of retention controller 28.

Figure 4:
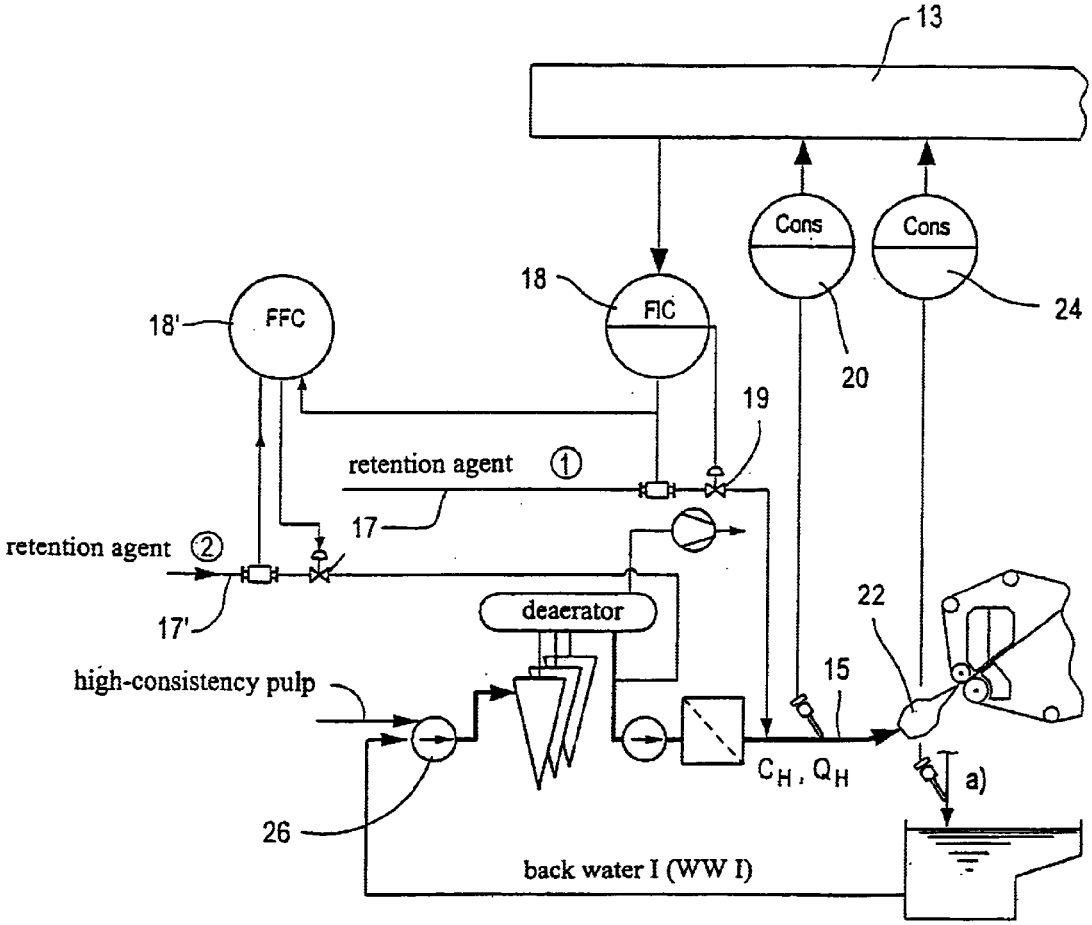
FIG. 4 schematically illustrates the regulation system of another embodiment of the apparatus according to the invention for manufacturing a fibrous material web in which a second retention agent is added.

FIG. 4 shows a schematic partial representation of the regulation system of another embodiment of the apparatus according to the invention for manufacturing a fibrous material web, which regulation system essentially differs from the one in FIG. 2 in that both a first retention agent 1 and a second retention agent 2 are added in the dual system.

In the regulation described purely by way of example, the retention controller 18 obtains from higher level formation controller 13 a target value for the mass flow rate or volume flow rate of first retention agent 1 as a function of the formation.

Second retention agent 2 is corrected by a ratio controller 18'. Ratio controller 18' obtains a target value for the ratio from higher level formation controller 13, wherein this target value depends upon the retention and/or the formation and/or at least one stock parameter such as, e.g., the stock type (for example, short-fibered, long-fibered, recycled fiber, mixtures thereof, etc.).

In other respects this regulation system can again be laid out at least essentially the same as that in FIG. 2, for example. Corresponding components are assigned the same reference characters.

Figure 5:
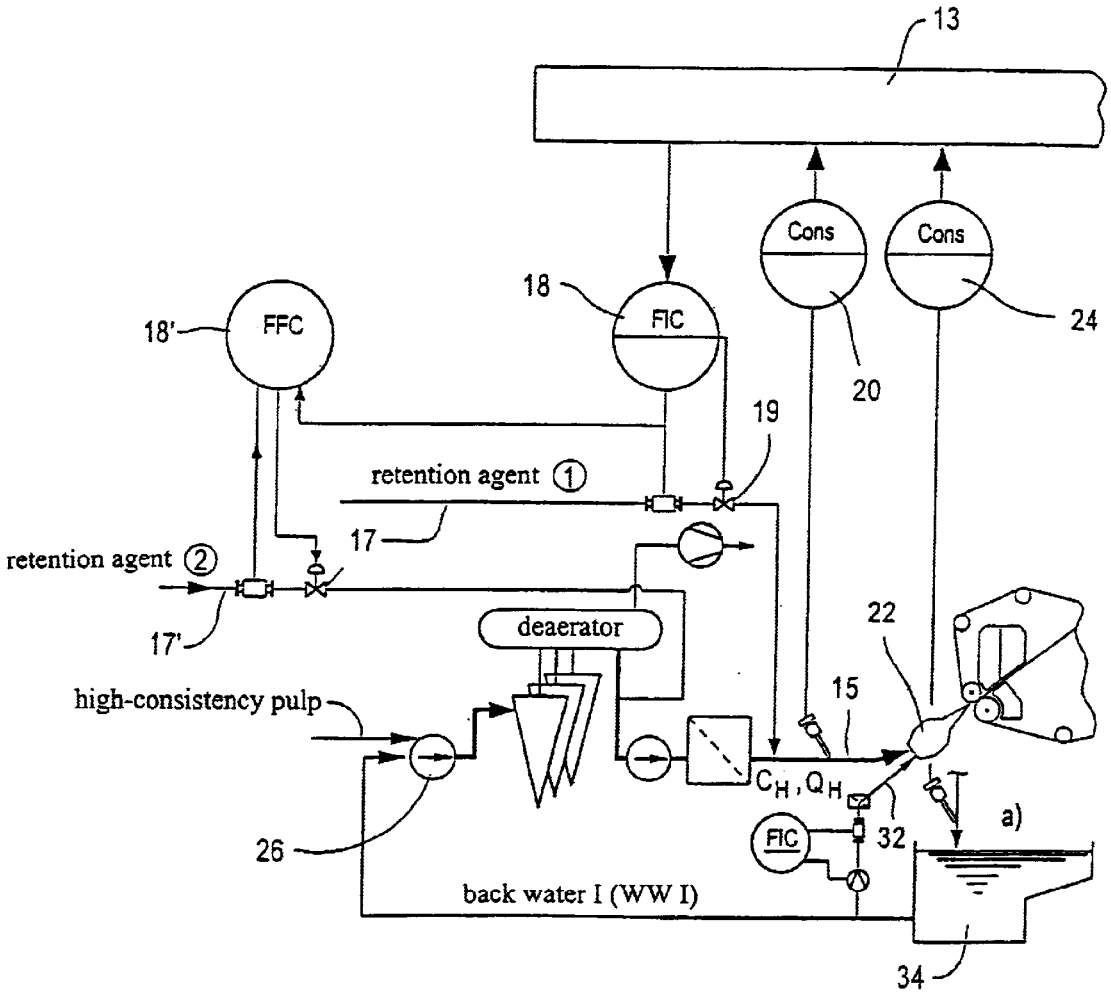
FIG. 5 schematically illustrates a part of the regulation system of another embodiment of the apparatus according to the invention for manufacturing a fibrous material web with supply of part of the back water I directly to the headbox.

FIG. 5 shows a schematic partial representation of the regulation system of another embodiment of the apparatus according to the invention for manufacturing a fibrous material web. In contrast to that in FIG. 4, this embodiment is supplemented by a supply 32 of part of the back water I directly to headbox 22.

This supply 32 is required for the sectional cross profile regulation of the basis weight (cf., e.g., ModuleJet) with diluent water headboxes. In the present exemplary embodiment, this back water partial volume flow is flow controlled (FIC, flow indicated control), and flows directly from back water container 34 to headbox 22.

For instance, it is also possible to conduct this back water partial flow through a deaerator commensurate with the high-density pulp and the back water I.

In this exemplary embodiment, instead of the measured consistency value $C_H$ ahead of the point where the back water partial flow I and the volume flow $Q_H$ are mixed, it is possible but not mandatory to supply the consistency value $Q_M$, i.e. the relevant value after the mixing point, via measurement device 20 to formation controller 13.

In dual systems, the two different retention agents can, for example, comprise polymers with different charge densities (anionic/cationic) and/or different molecular weights. Thus, the two different retention agents can comprise, e.g., polyethylene imine (PEI) and polyacrylamide (PAM).

For instance, it is also possible to use a polymer, e.g. polyacrylamide, as the first retention agent, and inorganic microparticles, e.g. bentonite, hydrocol, etc., as the second retention agent. Thus, for example, a polymer can be used for coarse flocculation and an agent for fine flocculation.

Through the use of fuzzy logic and predictive controls, it is also possible to take into account more complex relationships between the formation and raw materials influences and the water flow in the wet section.

Thus, for example, when short-fibered raw materials are used, the formation is worsened to a lesser extent with increasing retention than when long-fibered raw materials are employed.

This material-dependent relationship between formation and retention can be taken into account in the control algorithm. This can be accomplished, for example, within the framework of a formation regulation superimposed over a retention regulation (cf. FIG. 3, in particular), or in that the ratio $Q_{R1}/Q_{R2}$ of the mass flows of the retention agents of the dual system are also selected by fiber type (raw material type).

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

| | |
|---|---|
| 1 | first retention agent |
| 2 | second retention agent |
| 10 | apparatus for manufacturing a fibrous material web |
| 12 | fibrous material web |
| 13 | formation controller |
| 14 | wind-up |
| 15 | feed inlet |

-continued

| List of Reference Characters | |
|---|---|
| 16 | measurement device |
| 17 | line |
| 18' | ratio controller |
| 18 | flow controller |
| 19 | actuator, valve |
| 20 | stock consistency value |
| 22 | headbox |
| 24 | stock consistency value |
| 26 | mixing pump |
| 28 | retention controller |
| 30 | output value |
| 32 | supply |
| 32 | back water container |
| a) | consistency measurement point |
| b) | consistency measurement point |

What is claimed:

1. A process for manufacturing a fibrous material web in an apparatus having an automatic formation regulator, said process comprising:

on-line measuring of formation of the fibrous material web;

utilizing the on-line measured formation as a controlled variable; and maintaining the formation at a preselectable target level via the automatic formation regulator by changing an added quantity of at least one retention agent.

2. The process in accordance with claim 1, wherein the fibrous material web comprises one of a paper or cardboard web.

3. The process in accordance with claim 1, further comprising continually maintaining retention at a maximum possible value.

4. The process in accordance with claim 1, wherein different retention agents are added at different points, and said process further comprises adjusting the retention.

5. The process in accordance with claim 4, wherein the two different retention agents comprise polyethylene imine (PEI) and polyacrylamide (PAM).

6. The process in accordance with claim 1, wherein two different retention agents are added at two different points, and said process further comprises constantly maintaining the retention at a preselectable high level.

7. The process in accordance with claim 1, wherein two different retention agents are added at two different points, and said process further comprises maintaining the formation at the preselectable target level by changing a ratio of added quantities of the two different retention agents.

8. The process in accordance with claim 1, wherein two different retention agents are added at two different points, and the two different retention agents comprise polymers with at least one of different charge densities and different molecular weights.

9. The process in accordance with claim 8, wherein the different charge densities comprise anionic/cationic differences.

10. The process in accordance with claim 1, further comprising one of adjusting or regulating the formation by one of increasing and decreasing a constant ratio $Q_{R1}/Q_{R2}$, wherein $Q_{R1}$ and $Q_2$ represent retention agent mass flows.

11. A process for manufacturing a fibrous material web in an apparatus having an automatic formation regulator, said process comprising:

on-line measuring of formation of the fibrous material web;

utilizing the on-line measured formation as a controlled variable;

maintaining the formation at a preselectable target level via the automatic formation regulator; and wherein after the on-line measurement of the formation, the process further comprises:

comparing the measured value to a target value;

adjusting an added quantity of a first retention agent of a dual system to match the formation to the target value; and correcting one of an added quantity of a second retention agent and a ratio between the added quantities of the two retention agents to a point at which the formation begins to worsen.

12. The process in accordance with claim 11, wherein the correcting enables the setting of a highest possible level of retention.

13. The process in accordance with claim 1, wherein the formation regulation is superimposed on a retention regulation.

14. The process in accordance with claim 1, wherein two different retention agents are added at two different points, wherein a first retention agent comprises a polymer and a second retention agent comprises inorganic microparticles.

15. The process in accordance with claim 1, wherein the polymer comprises polyacrylamide and the inorganic microparticles comprise at least one of bentonite and hydrocol.

16. The process in accordance with claim 1, wherein at least one of raw material influences and water flow in a wet section are included in formation regulation.

17. The process in accordance with claim 1, wherein formation regulation utilizes at least one of fuzzy logic and predictive controls.

18. The process in accordance with claim 1, wherein at least one of at least one on-line measured formation value and at least one stock consistency value is input into a controller for regulating the formation, and the process further comprises adjusting a level of the formation by using a manipulated variable output by the controller to adjust one of a mass flow rate or volume flow rate of at least one retention agent.

19. The process in accordance with claim 18, wherein said at least one stock consistency value comprises at least one of the stock consistency value of the low consistency back water and the stock consistency value of the high consistency fiber suspension to the headbox.

20. The process in accordance with claim 19, wherein the low consistency back water comprises white water.

21. The process in accordance with claim 18, wherein at least one value for at least one stock parameter is input to the controller as an additional input variable.

22. An apparatus for manufacturing a fibrous material web comprising:

an on-line measuring device structured and arranged to measure formation of the fibrous material web;

an automatic formation regulator structured and arranged to receive the formation of the fibrous material web from said on-line measuring device as a controlled variable, and to maintained the formation at a preselectable target level; and a device for changing an added quantity of at least one retention agent, wherein the changing of the added quantity of the at least one retention agent maintains the formation at the preselectable target level.

23. The appartus in accordance with claim 22, further comprising a device to continually maintain retention at a respective maximum possible value.

24. The apparatus in accordance with claim 22, further comprising devices for adding two different retention agents at two different points, and a device structured and arranged to constantly maintain the retention at a preselectable high level.

25. The apparatus in accordance with claim 22, further comprising devices for adding two different retention agents at two different points, and a device structured and arranged to maintain the formation at the preselectable target level by changing quantities of the two added retention agents.

26. The apparatus in accordance with claim 22, further comprising devices for adding two different retention agents at two different points, wherein the two different retention agents comprise polymers with at least one of different charge densities and different molecular weights.

27. The apparatus in accordance with claim 26, wherein the different charge densities comprise anionic/cationic differences.

28. The apparatus in accordance with claim 22, further comprising a device for one of adjusting or regulating the formation by one of increasing and decreasing a constant ratio $Q_{R1}/Q_{R2}$, wherein $Q_{R1}$ and $Q_{R2}$ represent retention agent mass flows.

29. A apparatus for manufacturing a fibrous material web comprising:

an on-line measuring device structured and arranged to measure formation of the fibrous material web;

an automatic formation regulator structured and arranged to receive the formation of the fibrous material web from said on-line measuring device as a controlled variable, and to maintained the formation at a preselectable target level;

a device for comparing a measured formation value to a target value;

a device for adjusting an added quantity of a first retention agent of a dual system to match the formation to the target value; and a device for correcting one of an added quantity of a second retention agent and a ratio between the added quantities of the two retention agents to a point at which the formation begins to worsen.

30. The apparatus in accordance with claim 29, wherein the device for correcting enables the setting of a highest possible level of retention.

31. The apparatus in accordance with claim 22, wherein the automatic formation regulator is superimposed on a retention regulator.

32. The apparatus in accordance with claim 22, further comprising a device for adding different retention agents at different points, and a device for adjusting retention.

33. The apparatus in accordance with claim 32, wherein the two different retention agents comprise polyethylene imine (PEI) and polyacrylamide (PAM).

34. The apparatus in accordance with claim 22, further comprising a device for adding two different retention agents at two different points, wherein a first retention agent comprises a polymer and a second retention agent comprises inorganic microparticles.

35. The apparatus in accordance with claim 34, wherein the polymer comprises polyacrylamide and the inorganic microparticles comprise at least one of bentonite and hydrocol.

36. The apparatus in accordance with claim 22, wherein said automatic formation regulator is coupled receive data related to at least one of raw material influences and water flow in a wet section.

37. The apparatus in accordance with claim 22, wherein said automatic formation regulator utilizes at least one of fuzzy logic and predictive controls.

38. The apparatus in accordance with claim 22, wherein said automatic formation regulator is structured and arranged to receive as input at least one of at least one on-line measured formation value and at least one stock consistency value, and said automatic formation regulator is structured and arranged to adjust a level of the formation by using a manipulated variable output in order to adjust one of a mass flow rate or volume flow rate of at least one retention agent.

39. The apparatus in accordance with claim 38, wherein said at least one stock consistency value comprises at least one of the stock consistency value of the low consistency back water and the stock consistency value of the high consistency fiber suspension to the headbox.

40. The apparatus in accordance with claim 39, wherein the low consistency back water comprises white water.

41. The apparatus in accordance with claim 38, wherein at least one value for at least one stock parameter is input to said automatic formation regulator as an additional input variable.

* * * * *